US006234089B1

(12) United States Patent
Zheng et al.

(10) Patent No.: US 6,234,089 B1
(45) Date of Patent: May 22, 2001

(54) FOLDABLE TABLE TOP

(75) Inventors: Edward Zheng, La Verne, CA (US); Paul Zheng, Lang Shaw Fu (CN)

(73) Assignee: Tofasco of America, Inc., La Verne, CA (US)

( * ) Notice: Subject to any disclaimer, the term of this patent is extended or adjusted under 35 U.S.C. 154(b) by 0 days.

(21) Appl. No.: 09/363,538

(22) Filed: Jul. 29, 1999

(51) Int. Cl.[7] ..... A47B 3/00
(52) U.S. Cl. ..... 108/115; 108/34; 108/159
(58) Field of Search ..... 108/34, 35, 36, 108/67, 115, 157.16, 99, 119, 157.18, 118, 124, 157.12, 158.11, 158.12, 159, 154, 155, 157.1, 157.15; 248/176.3, 166

(56) References Cited

U.S. PATENT DOCUMENTS 557,045 * 3/1896 Baxter ..... 108/34 X
1,262,356 * 4/1918 Kirkland ..... 108/159 X
1,295,194 * 2/1919 Parelius ..... 108/159 X
2,638,394 * 5/1953 Ulrich ..... 108/34
5,644,994 * 7/1997 Liang et al. ..... 108/115 X
5,645,259 * 7/1997 Chen ..... 108/118 X
6,026,751 * 2/2000 Tsai ..... 108/115 X

FOREIGN PATENT DOCUMENTS

62019 * 2/1944 (DK) ..... 108/118
27891 * 11/1898 (GB) ..... 108/34
2165441 * 4/1986 (GB) ..... 108/34

* cited by examiner

*Primary Examiner*—Janet M. Wilkens
(74) *Attorney, Agent, or Firm*—Raymond Y. Chan; David and Raymond

(57) ABSTRACT

A foldable table top for use with a portable table frame includes a plurality of longitudinal table strips laying side by side, a connecting band extended perpendicularly across the longitudinal table strips for connecting the longitudinal table strips side by side together to form a table top-board, a pair of crossing bands extended across and affixed to the longitudinal table strips in a "X" manner, and a securing device for securely mounting the table top on the collapsible table frame. The plurality of longitudinal strips are made of rigid and tensile material, interconnected by bands of stretchable material running diagonally in a crossing pattern and running vertically along the bottom surface of the table in such a manner as to allow the table to be stretched when placed on the portable table frame for use and to be easily folded for storage.

16 Claims, 7 Drawing Sheets

FOLDABLE TABLE TOP

FIELD OF THE PRESENT INVENTION

The present invention relates to a foldable table top, and more particularly to a foldable table top comprising a set of interconnected strips of a rigid material that may be stretched over the top of a portable table frame forming a stable table top in which the strips maintain their alignment when in the open state, allowing for a stable, rigid, and flat surface.

BACKGROUND OF THE PRESENT INVENTION

A picnic table placed in the middle of the desert. A card table sitting in the middle of the woods. A dining table placed next to the campfire. Unless there is a private or public campground surrounding the aforementioned desert, woods, or campfire, it is unlikely that a table will be sitting there for a camper to use. Even in a campground, not every campsite has picnic tables. And for the camper that camps in a less populated area, there will certainly not be any tables around for the camper to use.

The larger the group, the more important it may be to have a table available. This is particularly true for a family of campers. That means that the camper must bring his own table. Moreover, a camper requires a table that is portable, so that he may move the item easily to the location.

Historically, the first portable table sets were one piece, tabletop and "frame," really just the legs of the table, connected together. Typically, the table was made of a non-bending stiff structure, usually metal, with legs that fold underneath and into the table. The problem with this type of conventional table is that it is bulky, usually very heavy, and difficult to carry. Also, because the "table frame" is limited to four vertical legs, either the whole set must be heavy and be of limited portability, or be lightweight and not very sturdy. Also, with this type of conventional portable table, because the table does not fold up and disconnect from the frame, or legs in this instance, a conventional portable table of the aforementioned type cannot fold up to be easily transportable in any type of car.

As a result, in today's market, the direction of the manufacturers is to provide a table frame and tabletop of greater portability. One way that this has been achieved is to construct a separate portable table top and separate portable table frame. The present day conventional portable tabletops are collapsible, so that they are easily transportable. One significant problem with this collapsible table is finding a way to solve a number of problems at once, namely, finding a sturdy enough material for the table top so that when the table top is opened, there is a flat, sturdy table top on which to place things, allowing the table top to collapse or fold easily, finding a way to secure the table top to a table frame, and giving the table top enough structure so that when opened and secured to a table frame, the table top retains its form, without warping, or where the table top is made of several connected pieces, the pieces do not move around when the table top is opened.

SUMMARY OF THE PRESENT INVENTION

The main object of the present invention is to provide a foldable table top for use with a portable table frame for portable use, that provides a foldable table top which may be opened to provide a rigid, flat surface, when placed on a portable table frame, namely, by having at least two crossing bands of stretchable material integrally attaching along the underside of a set of longitudinal strips of the table top in such a manner as to allow the longitudinal strips of the table top to be stretched apart as the table top is placed over and attached to a table frame.

Another object of the present invention is to provide a foldable table top made of lightweight but sturdy material to allow the placement of objects on the table top without the danger of the objects falling over, or off the table, namely, by having a table frame securing means, which secures the table top to the table frame in a such a manner as to prevent the foldable table top from moving when the table top is connected to the table frame.

Another object of the present invention is to provide a foldable table top that is easily removed from a table frame and foldable for easy transportation, by using strips of rigid material for the table top, connected together by the crossing bands of stretchable material, and a frame attaching means, which allows the table to be attached and detached from a table frame by stretching the stretchable material, thereby pulling the strips apart and pulling the table on or off the frame so that the table top will be attached or detached from the table frame.

An unexpected result of the crossing bands of stretchable material is an increase in the rigidity of the center of the table top creating greater rigidity and support in the center of the table top when the table top is in the open state.

Accordingly, in order to accomplish the above objects, the present invention provides a foldable tabletop for use with a portable table frame, wherein the foldable tabletop comprises:

- a plurality of longitudinal table strips, adapted for lying in parallel when the foldable table top is in the open state;
- two crossing bands made of stretchable material being integrally connected to a bottom side of the longitudinal table strips, wherein each of said crossing bands is integrally connected to each longitudinal table strip by a band connecting means;
- at least one connecting band made of stretchable material integrally connecting to the bottom side of the plurality of longitudinal table strips perpendicularly to the longitudinal table strip by means of the band connecting means; and
- a table frame mounting device for connecting to the set of longitudinal table strips of the foldable table top.

DETAILED DESCRIPTION OF THE PREFERRED EMBODIMENT

Figure 1:
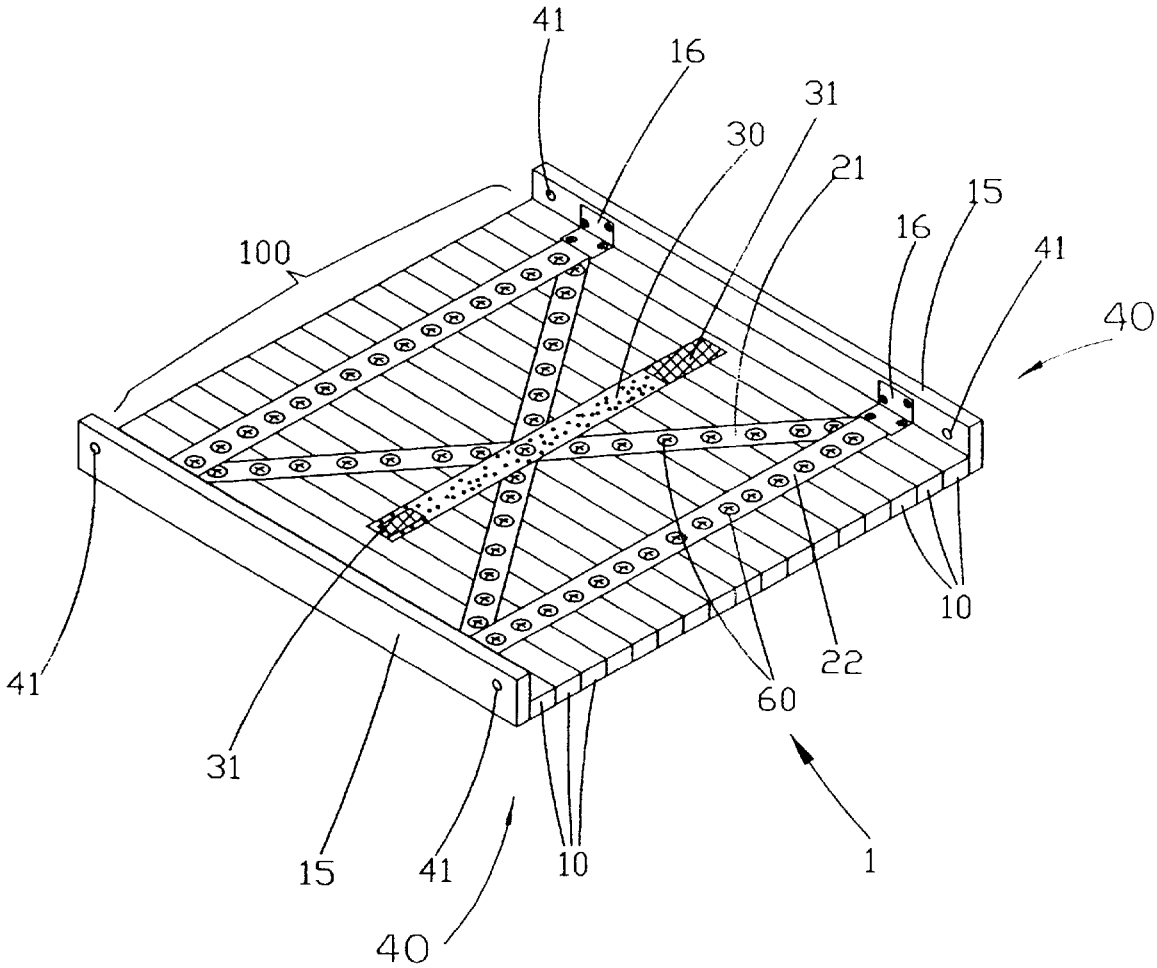
FIG. 1 is a bottom perspective view of a foldable table top in the open state according to a preferred embodiment of the present invention.
Figure 2:
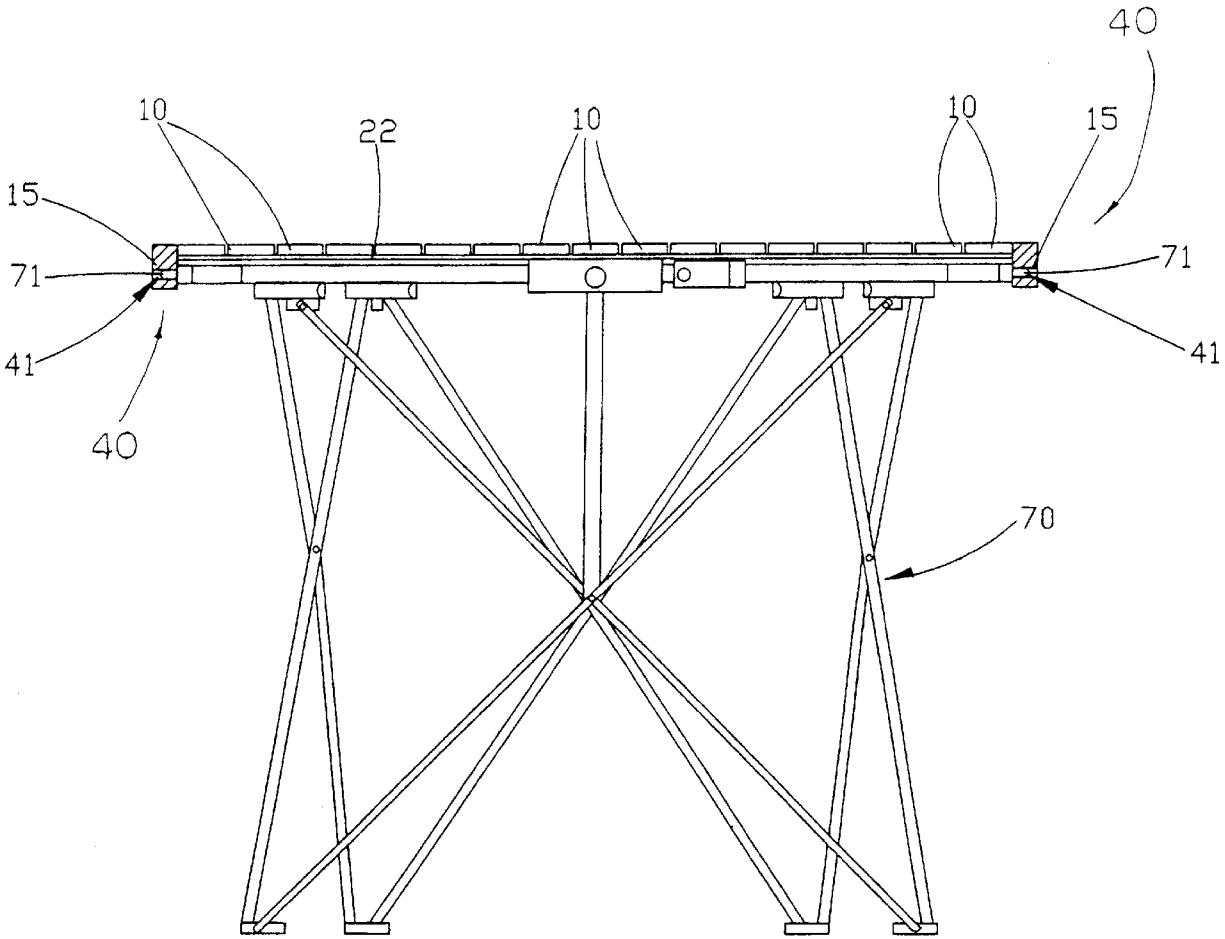
FIG. 2 is a side view of the foldable table top in the open state on a table frame according to the above preferred embodiment of the present invention.
Figure 3:
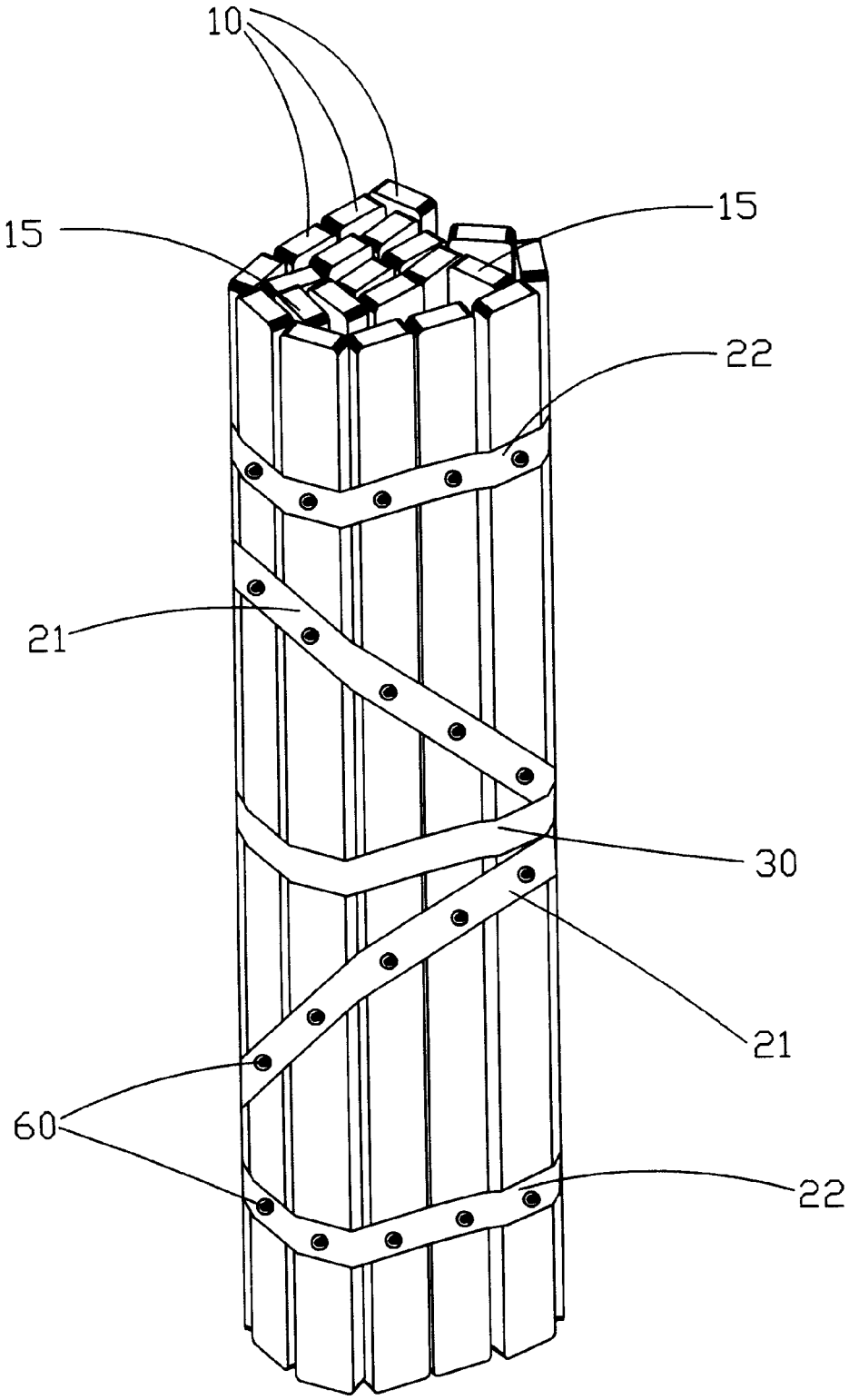
FIG. 3 is a perspective view of the foldable table top in the folded state according to the above preferred embodiment of the present invention.

Referring to FIGS. 1 to 3 of the drawings, a foldable table top 1 according to a preferred embodiment of the present invention comprises a plurality of longitudinal table strips 10 laying side by side, two crossing bands 21 and two connecting bands 22 attached to a bottom of the foldable table top 1 for connecting the longitudinal table strips side by side together to form a table top-board 100, a storage belt 30 for holding the foldable table top 1 together when folded up, and a securing means 40 for mounting the table top 1 on a table frame 70.

As illustrated in FIG. 2, when the foldable table top 1 is in the open state, the longitudinal table strips 10 of the table top-board 100 aligned side by side to provide a flat surface defining the table surface. As illustrated in FIG. 1, the longitudinal table strips 10 are connected together by the two crossing bands 21 and the two connecting bands 22 that they are all made of elastic and stretchable material. The two parallel connecting bands 22 are extended perpendicularly with the longitudinal table strips 10 and affixed to the longitudinal table strips 10 so as to stretchably bind the longitudinal table strips 10 side by side together to form the table top-board 100.

The crossing bands 21 are extended between the two connecting bands 22 and affixed to the longitudinal table strips 10 in "X" manner. The two crossing bands 21 are essential for further holding the longitudinal table strips 10 together and preventing lateral movement of the longitudinal table strips 10 with respect to each other, so as to keep the rectangular or square shape of the table top 1 and maintain a flat surface for the table top 1. This also has the desired effect of preventing warping of the table top 1. In other words, since each longitudinal table strip 10 is connected to two connecting bands 22 and two crossing bands 21, this prevents the longitudinal table strips 10 from moving side to side.

The connecting bands 22 and the crossing bands 21 are affixed to each of the longitudinal table strips 10 by a band connecting means 60. As shown in FIG. 1, according to the preferable embodiment, the band connecting means 60 comprises a plurality of screws to firmly screw the connecting bands 22 and the crossing bands 21 to the longitudinal table strips 10 respectively.

The securing means 40, for securely mounting the table top of the present invention on the collapsible table frame 70, comprises two longitudinal end strips 15, which are affixed and extended along the two outermost longitudinal table strip 10 in a downwardly projected manner respectively. Each longitudinal end strip 15 is affixed to the respective longitudinal table strip 10 by an end strip affixing means 16. According to the preferable embodiment as shown in FIG. 1, the end strip affixing means 16 comprises two pair of L-shaped connection joints for connecting the two longitudinal end strips 15 to the two outermost longitudinal table strips 10, wherein each of the connection joints comprises a horizontal piece affixed to the outermost longitudinal table strip 10 and a vertical piece affixed to the longitudinal end strip 15.

Each of the longitudinal end strips 15, according to the preferred embodiment as shown in FIGS. 1 and 2, comprises two circular securing holes 41 provided near two ends of the longitudinal end strip 5. The two securing holes 41 are the same distance from either end of the longitudinal end strip 15.

As illustrated in FIG. 2, the securing means 40 further comprises two pairs of locking projections 71 each having a circular cross section and a diameter equal to or slightly smaller than the securing holes 41, wherein a first pair of the locking projections 71 are outwardly and horizontally extended from two top corners of one side the collapsible table frame 70 and the second pair of the locking projections 71 are outwardly and horizontally extended from two top corners of another opposite side of the collapsible table frame 70.

Therefore, in order to mount the foldable table top 1 over the table frame 70, the user may first place the foldable table top 1 on the table frame 70 in such a manner that the two longitudinal end strips 15 are respectively positioned at the two sides of the table frame 70 with locking projections 71 extended therefrom. Then, the user can pull the two longitudinal end strips 15 away from each other by stretching the crossing bands 21 and the connecting bands 22 of the foldable table top 1 in such a manner as to separate the longitudinal table strips 10 from each other along a horizontal plane, so as to increase the width of the table top 1 to enable the user to easily engage the four securing holes 41 onto the four locking projections 71. Afterwards, the crossing bands 21 and the connecting bands 22 will rehold the longitudinal table strips 10 toward each other that renders the four locking projections 71 plugging into the four securing hole 41 respectively so as to firmly mount the table top 1 on the table frame 70, creating a stable, sturdy table. It is worth to mention that when the foldable table top 1 is stretched and placed on the table frame 70, the two crossing bands 21 substantially reinforce the support strength of the table top-board 100 constructed by the longitudinal table strips 15.

As illustrated in FIG. 3, the foldable table top 1 may be folded by rolling up to a folded state for storage. Additionally, according to the preferred embodiment of the present invention, the folding strap 30 is affixed to a central position of the foldable table top 1 for tying up the foldable table top 1 by means of loop and hook fasteners 31, as shown in FIGS. 1 and 3.

Figure 4:
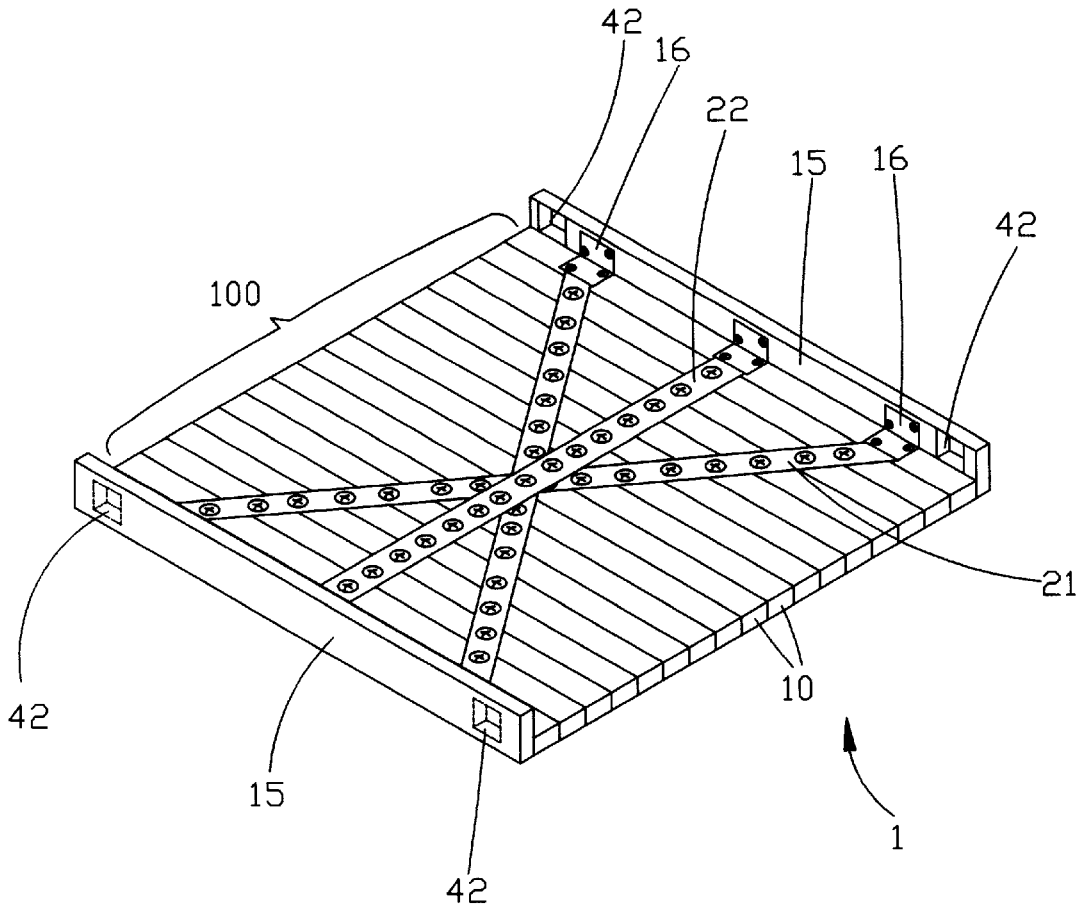
FIG. 4 is a bottom perspective view of a foldable table top in the open state according to a first alternative mode of the above preferred embodiment of the present invention.
Figure 5:
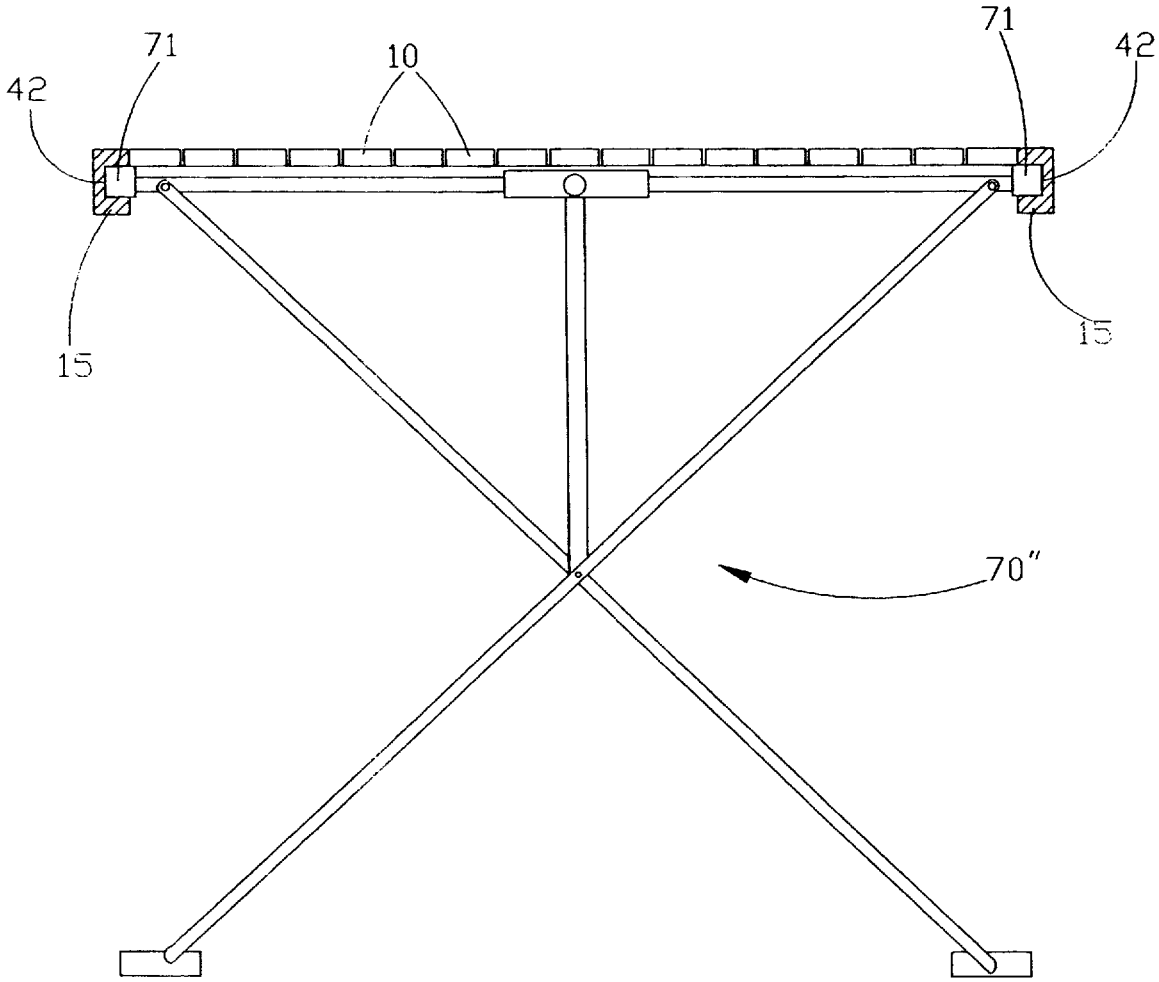
FIG. 5 is a side view of the foldable table top in the open state on a table frame according to the above first alternative mode of the above preferred embodiment of the present invention.
Figure 6:
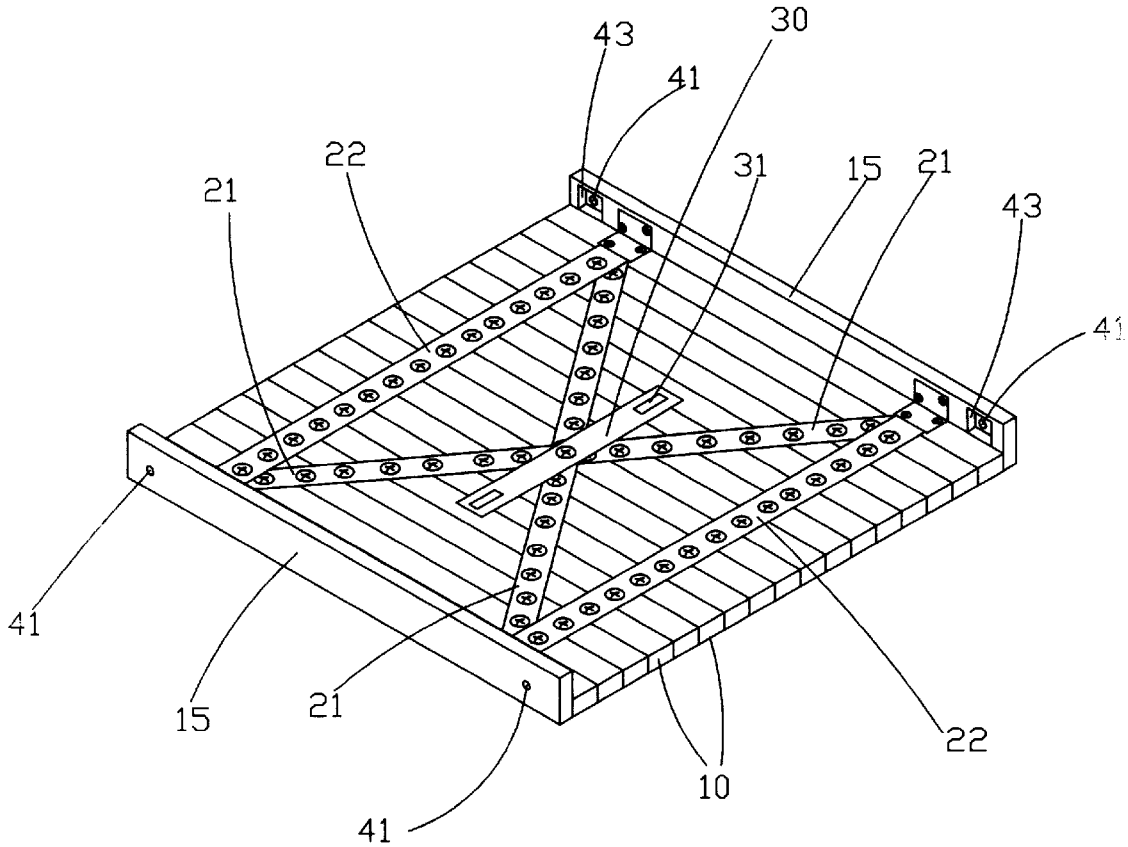
FIG. 6 is a bottom perspective view of a foldable table top in the open state according to a second alternative mode of the above preferred embodiment of the present invention.

Referring to FIGS. 4 to 6, a first and a second alternative mode of the above preferable embodiment are illustrated.

As shown in FIGS. 4 and 5, each of the through hole type securing hole 41 as shown in FIGS. 1 to 3 is alternatively substituted with a square securing indention 42 and each of the locking projections 71 of the frame 70" is made to have a square cross section adapted to engage inside the respective square securing indention 42 as shown in FIG. 5. Moreover, in the first alternative mode, only one longitudinal connecting strip 22 is provided to extend and affix across a central position of all the longitudinal table strips 10. FIG. 6 illustrates the second alternative mode of the preferable embodiment, wherein each of the securing holes 41 further has an enlarged square entrance securing indention 43 and each of the locking projections 71 also has an enlarged square base 72 to engage with the respective entrance securing indention 43 while the locking projection 71 insert through the respective securing hole 41 for further enhance the connecting between table top 1 and the table frame 70 in a more stable and rigid manner.

Figure 7:
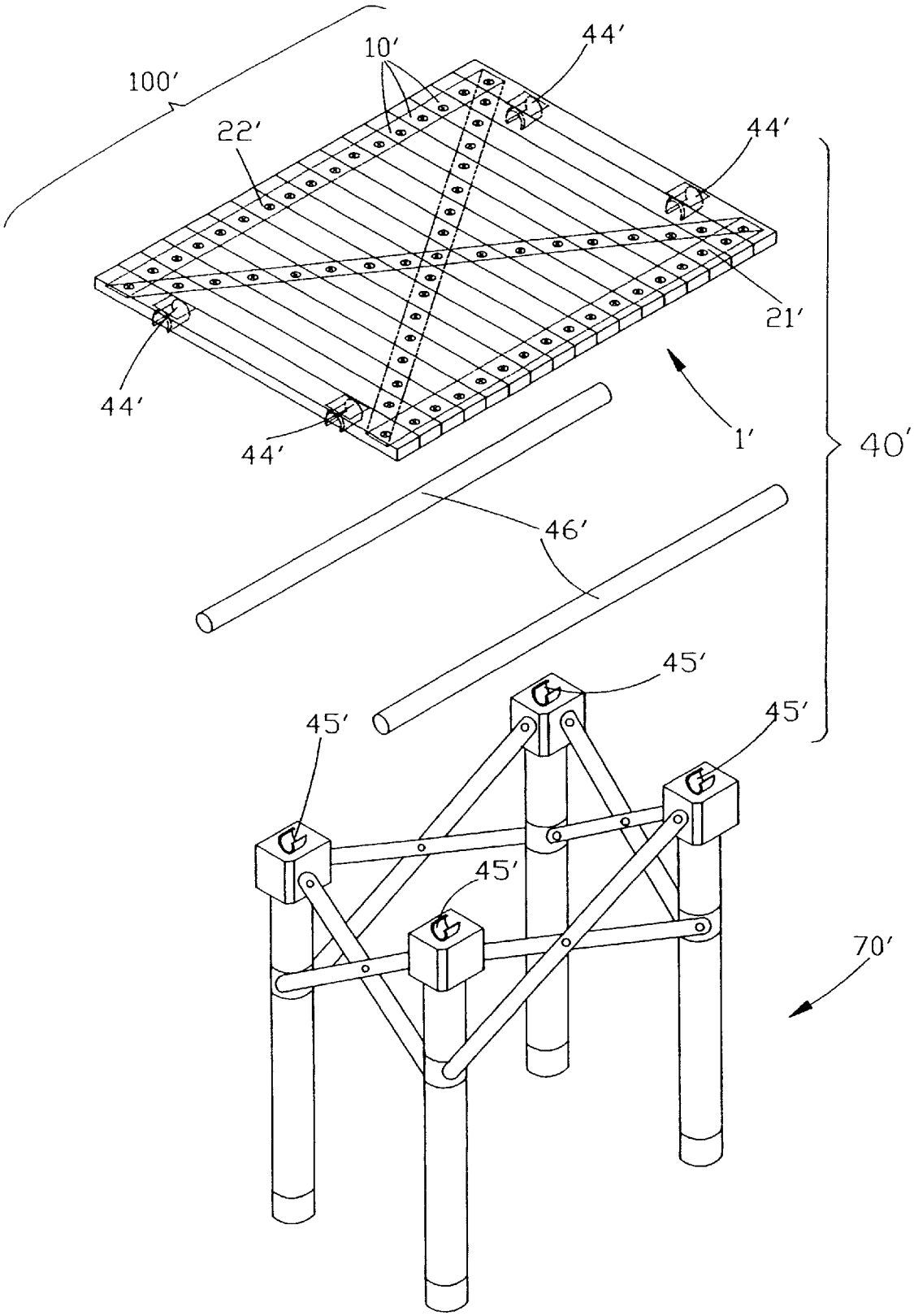
FIG. 7 is an exploded perspective view of a foldable table top in the open state according to a third alternative mode of the above preferred embodiment of the present invention.

Referring to FIG. 7, a third alternative mode of the present invention is illustrated, wherein the table top 1' also comprises a table top-board 100' constructed by connecting a plurality of longitudinal table strips 10' side by side with at least a stretchable connecting band 21' and two stretchable crossing bands 22' and a securing means 40' for securely mounting the table top-board 100' on a collapsible table frame 70'.

The securing means 40' comprises four table mounts 44' affixed at two end portions of two outermost longitudinal table strip 10', two pair of frame mounts 45' affixed at four top ends of the collapsible table frame 70', and two holding posts 46' adapted to detachably mount on the two pair of frame mounts 45' respectively. Each of the table mounts 44' and the frame mounts 45' consists of a C-shape catch adapted for attaching on the two holding posts 46'. Therefore, the table top 1' can be mounted on the table frame 70' by attaching the four table mounts 44' on the two holding posts 46'.

It is also worth to mention that the band attaching means 60 may interchangeably be screws, bolts, nails or staples, or any other commonly used means of connecting two materials together.

The present invention may be varied in form and application without departing from its essential sections herein disclosed. It is therefore intended that the embodiments herein are merely illustrative and not restrictive and that the patent shall cover all novelty herein set forth, reference to the following claims rather than the specific description to indicate the scope of the invention.

What is claimed is:

1. A foldable table top mounted on a collapsible table frame, comprising:

a plurality of longitudinal table strips laying side by side, at least a connecting band extended perpendicularly across said longitudinal table strips so as to connect said longitudinal table strips side by side together to form a table top-board, at least a crossing band inclinedly extended across and affixed to said longitudinal table strips, and a securing means for mounting said table top on said collapsible table frame, wherein said securing means comprises two longitudinal end strips, which are affixed and extended along the two outermost strips of said longitudinal table strips in a downwardly projected manner respectively, wherein each of said longitudinal end strips affixed to said respective longitudinal table strip having two circular securing holes provided near two ends of said longitudinal end strip, said securing means further comprising two pairs of locking projections, wherein a first pair of said locking projections are outwardly and horizontally extended from two top corners of one side of said collapsible table frame and a second pair of said locking projections are outwardly and horizontally extended from two top corners of another opposite side of said collapsible table frame, thereby said foldable table top is capable of mounting over said table frame by first placing said foldable table top on said table frame in such a manner that said two longitudinal end strips are respectively positioned at said two sides of said table frame with locking projections extended therefrom, and then pulling said two longitudinal end strips away from each other by stretching said crossing band and said connecting band of said foldable table top in such a manner as to separate said longitudinal table strips from each other along a horizontal plane, so as to increase a width of said table top for facilitating said four securing holes to engage with said four locking projections.

2. The foldable table top as recited in claim 1 wherein said longitudinal table strips of said table top-board are aligned side by side to provide a flat table surface for said table top-board, and said longitudinal table strips are connected together by two of said connecting bands that are made of stretchable material, wherein said two connecting bands are extended parallelly with each other and perpendicularly with said longitudinal table strips.

3. The foldable table top as recited in claim 2 further comprising an additional crossing band, wherein said two crossing bands are extended between said two connecting bands and affixed to said longitudinal table strips in "X" manner.

4. The foldable table top as recited in claim 3 further comprising an end strip affixing means which comprises two pair of L-shaped connection joints for connecting said two longitudinal end strips to said two outermost longitudinal table strips, wherein each of said connection joints comprises a horizontal piece affixed to said outermost longitudinal table strip and a vertical piece affixed to said longitudinal end strip.

5. The foldable table top as recited in claim 3 wherein each of said securing holes further has an enlarged entrance securing indention and each of said locking projections also has an enlarged base for engaging with said respective entrance securing indention.

6. The foldable table top as recited in claim 1 further comprising an additional crossing band, wherein said two crossing bands are extended across and affixed to all of said longitudinal table strips in "X" manner.

7. The foldable table top as recited in claim 6 further comprising an end strip affixing means which comprises two pair of L-shaped connection joints for connecting said two longitudinal end strips to said two outermost strips of said longitudinal table strips, wherein each of said connection joints comprises a horizontal piece affixed to said outermost longitudinal table strip and a vertical piece affixed to said longitudinal end strip.

8. The foldable table top as recited in claim 6 wherein each of said securing holes further has an enlarged entrance securing indention and each of said locking projections also has an enlarged base for engaging with said respective entrance securing indention.

9. A foldable table top mounted on a collapsible table frame, comprising:

a plurality of longitudinal table strips laying side by side, at least a connecting band extended perpendicularly across said longitudinal table strips so as to connect said longitudinal table strips side by side together to form a table top-board, at least a crossing band inclinedly extended across and affixed to said longitudinal table strips, and a securing means for mounting said table top on said collapsible table frame, wherein said securing means comprises two longitudinal end strips, which are affixed and extended along the two outermost strips of said longitudinal table strips in a downwardly projected manner respectively, wherein each of said longitudinal end strips affixed to said respective longitudinal table strip comprising two securing indention provided near two ends of said longitudinal end strip, said securing means further comprising two pairs of locking projections, wherein a first pair of said locking projections are outwardly and horizontally extended from two top corners of one side of said collapsible table frame and a second pair of said locking projections are outwardly and horizontally extended from two top corners of another opposite side of said collapsible table frame, thereby said foldable table top is capable of mounting over said table frame by first placing said foldable table top on said table frame in such a manner that said two longitudinal end strips are respectively positioned at said two sides of said table frame with locking projections extended therefrom, and then pulling said two longitudinal end strips away from each other by stretching said crossing band and said connecting band of said foldable table top in such a manner as to separate said longitudinal table strips from each other along a horizontal plane, so as to increase a width of said table top for facilitating said four locking projections to engage with said four securing indentions respectively.

10. The foldable table top as recited in claim 9 wherein said longitudinal table strips of said table top-board are aligned side by side to provide a flat table surface for said table top-board, and said longitudinal table strips are connected together by two of said connecting bands that are made of stretchable material, wherein said two connecting bands are extended parallelly with each other and perpendicularly with said longitudinal table strips.

11. The foldable table top as recited in claim 10 further comprising an additional crossing band, wherein said two crossing bands are extended between said two connecting bands and affixed to said longitudinal table strips in "X" manner.

12. The foldable table top as recited in claim 9 further comprising an additional crossing band, wherein said two crossing bands are extended across and affixed to all of said longitudinal table strips in "X" manner.

13. A foldable table top mounted on a collapsible table frame, comprising:

a plurality of longitudinal table strips laying side by side, at least a connecting band extended perpendicularly across said longitudinal table strips so as to connect said longitudinal table strips side by side together to form a table top-board, at least a crossing band inclinedly extended across and affixed to said longitudinal table strips, and a securing means for mounting said table top on said collapsible table frame, wherein said securing means comprises four table mounts affixed at two end portions of the two outermost strips of said longitudinal table strips, two pair of frame mounts affixed at four top ends of said collapsible table frame, and two holding posts adapted to detachably mount on said two pair of frame mounts respectively, wherein each of said table mounts and said frame mounts comprises a C-shape catch adapted for attaching on said two holding posts, so that said table top is capable of mounting on said table frame by attaching said four table mounts on said two holding posts.

14. The foldable table top as recited in claim 13 wherein said longitudinal table strips of said table top-board are aligned side by side to provide a flat table surface for said table top-board, and said longitudinal table strips are connected together by two of said connecting bands that are made of stretchable material, wherein said two connecting bands are extended parallelly with each other and perpendicularly with said longitudinal table strips.

15. The foldable table top as recited in claim 14 further comprising an additional crossing band, wherein said two crossing bands are extended between said two connecting bands and affixed to said longitudinal table strips in "X" manner.

16. The foldable table top as recited in claim 13 further comprising an additional crossing band, wherein said two crossing bands are extended across and affixed to all of said longitudinal table strips in "X" manner.

* * * * *